US006476770B1

(12) United States Patent
Eriksson

(10) Patent No.: US 6,476,770 B1
(45) Date of Patent: Nov. 5, 2002

(54) ANTENNA CARRIER FOR CONNECTION TO AN AIR VEHICLE

(75) Inventor: Sven Eriksson, Stenhamra (SE)

(73) Assignee: Totalforsvarets Forskningsinstitut, Stockholm (SE)

( * ) Notice: Subject to any disclaimer, the term of this patent is extended or adjusted under 35 U.S.C. 154(b) by 0 days.

(21) Appl. No.: 09/926,038

(22) PCT Filed: Feb. 7, 2000

(86) PCT No.: PCT/SE00/00232

§ 371 (c)(1),
(2), (4) Date: Aug. 20, 2001

(87) PCT Pub. No.: WO00/49679

PCT Pub. Date: Aug. 24, 2000

(30) Foreign Application Priority Data

Feb. 18, 1999 (SE) ..... 9900560

(51) Int. Cl.[7] ..... H01Q 1/28
(52) U.S. Cl. ..... 343/705
(58) Field of Search ..... 343/705, 708, 343/872

(56) References Cited

U.S. PATENT DOCUMENTS 5,323,170 A * 6/1994 Lang ..... 343/872

FOREIGN PATENT DOCUMENTS

| | | | |
|---|---|---|---|
| EP | 0 881 703 | 12/1998 | ..... H01Q/1/28 |
| FR | 2 680 282 | 2/1993 | ..... H01Q/3/16 |
| GB | 1 536 141 | 12/1978 | ..... H01Q/1/28 |
| GB | 2 113 922 | 8/1983 | ..... H01Q/1/28 |
| SE | 468 184 | 11/1992 | ..... G01S/13/90 |

* cited by examiner

*Primary Examiner*—Don Wong
*Assistant Examiner*—Hoang Nguyen
(74) *Attorney, Agent, or Firm*—Jacobson Holman PLLC

(57) ABSTRACT

Antenna carrier comprising antenna elements to be connected to an air vehicle, said antenna carrier projecting from a mounting area forwards or rearwards seen in the travelling direction of the air vehicle. The antenna carrier comprises an elongate front part (3), which comprises a flexurally rigid shell (6); an elongate, pliable mounting part (2), which at its front end (11) connects to the front part (3); a front mounting point (13) via which a front part of the mounting part (2) is connected to the air vehicle; and a rear mounting point (14) via which a rear part of the mounting part (2) is connected to the air vehicle. The flexural rigidity of the shell (6) of the front part and the mounting part (2) is adjusted in such manner that the eigenfrequencies of the antenna carrier are well separated from the critical eigenfrequencies of the air vehicle.

5 Claims, 4 Drawing Sheets

ANTENNA CARRIER FOR CONNECTION TO AN AIR VEHICLE

BACKGROUND OF THE INVENTION

1. Field of the Invention

The present invention relates to an antenna carrier comprising antenna elements to be connected to an air vehicle, said antenna carrier projecting from a mounting area forwards or rearwards seen in the longitudinal direction of the air vehicle.

2. Description of the Related Art

The development of the radar technique represented by SE 468 184 B produced the need for providing an aircraft with two parallel, elongate carriers of antenna elements. This was originally solved by means of two rearwardly directed soft bags of cloth which were mounted in the tail of the aircraft. Antenna elements in the form of flexible metal strips were fixed along each cloth bag. In flight, the cloth bags were filled with air, thus expanding and assuming the shape of two parallel cylinders. A problem arising in such rearwardly directed antenna carriers is the turbulence that arises behind the aircraft, which in unfavourable circumstances may cause strong vibrations in the antenna carriers. A further problem is the fact that the antenna carriers and the antenna elements are easily damaged in take-off and touchdown. Therefore a solution involving rigid antenna carriers have been found desirable.

An aircraft consists in mechanical terms of an elastic body with critical eigenfrequencies which vary depending on the type of aircraft. A type of aircraft on which it has been desirable to mount the above-mentioned parallel, elongate carriers of antenna elements has, for example, critical eigenfrequencies which are approximately in the range 5–20 Hz, For the antenna carriers to be supported in a stable and safe manner by the aircraft, their eigenfrequencies must be well separated from the critical eigenfrequencies of the aircraft, i.e. the eigenfrequencies of the antenna carrier must be well outside the range in question.

Forwardly and rearwardly directed antennae mounted on aircraft have been known for a long time in different designs. Since they have been relatively short, they could be formed with such high rigidity in antenna and mounting in relation to the length of the antenna that the eigenfrequencies of the antenna can be located above the critical eigenfrequencies of the aircraft. Moreover, in the usual design only one antenna of the forwardly or rearwardly directed type is attached to the aircraft, which allows the antenna to be fixed to a stronger structure such as the nose or tail of the aircraft. The prior-art constructions of forwardly and rearwardly directed antennae on aircraft have not been found suitable for supporting antenna elements in two parallel and relatively long antenna carriers.

BRIEF SUMMARY OF THE INVENTION

The object of the invention is to provide an antenna carrier which allows two parallel, relatively long, forwardly or rearwardly directed antenna carriers to be mounted on an air vehicle and be supported by the same in a stable and safe manner with small relative motions.

A further object is to provide an antenna carrier which is designed in such manner that the eigenfrequencies of the antenna carrier can easily be separated from the critical eigenfrequencies of the air vehicle.

The features of the invention are defined in the claims.

BRIEF DESCRIPTION OF THE DRAWINGS

The invention will now be described in more detail by way of embodiments and with reference to the accompanying drawings in which.

DETAILED DESCRIPTION OF THE PREFERRED EMBODIMENTS

Figure 1:
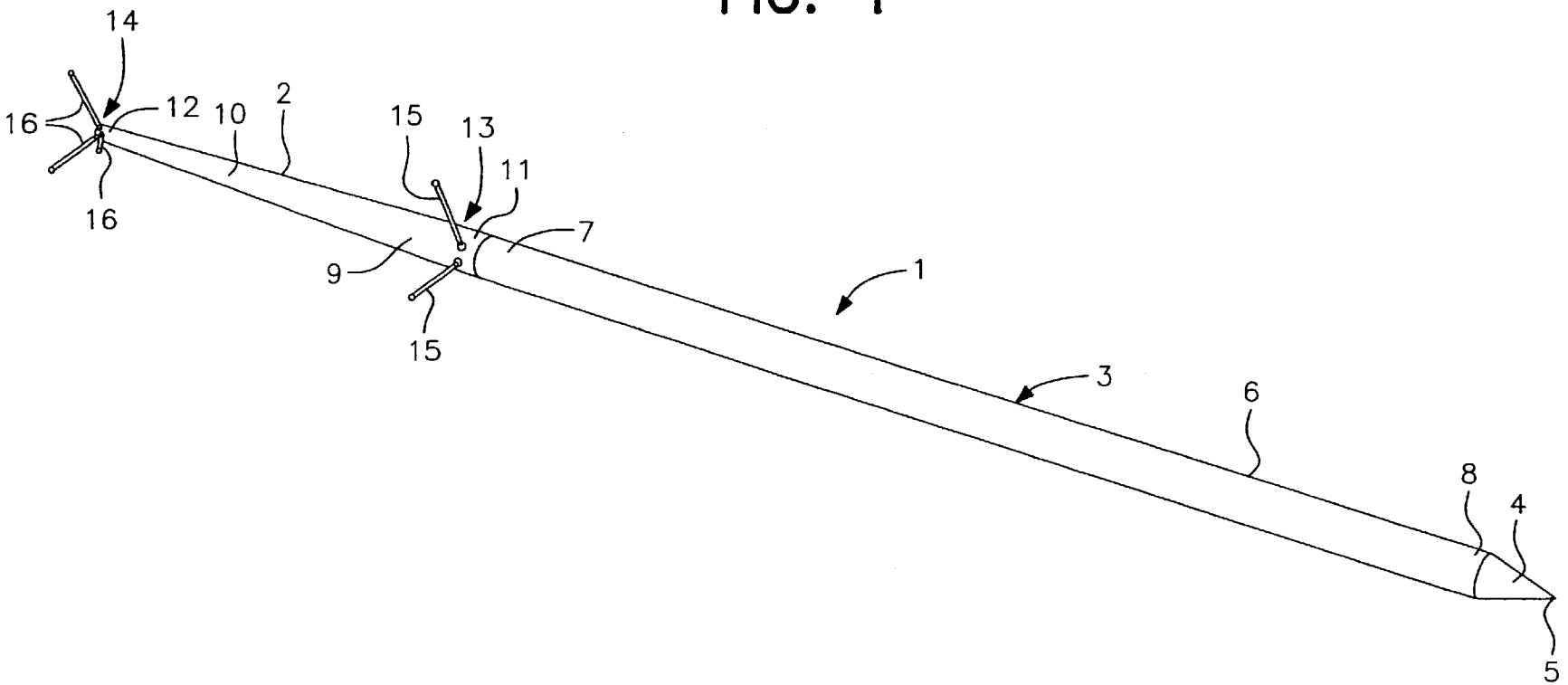
FIG. 1 is a perspective view of an antenna carrier according to the present invention.
Figure 2:
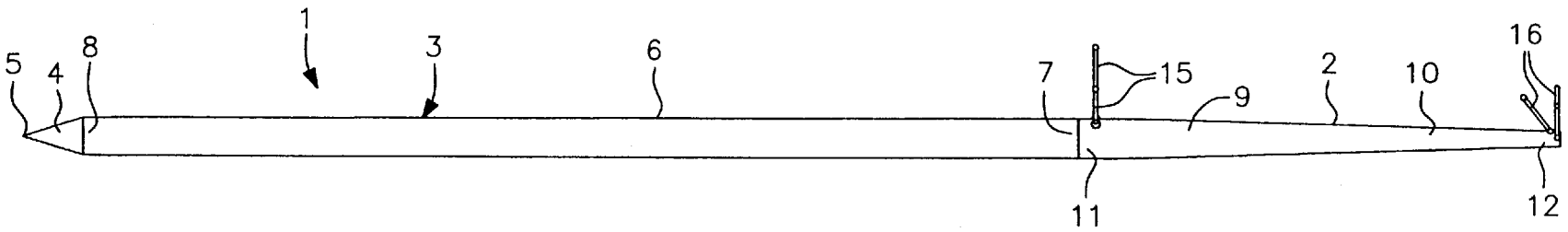
FIG. 2 is a left side view of the antenna carrier of FIG. 1.
Figure 3:
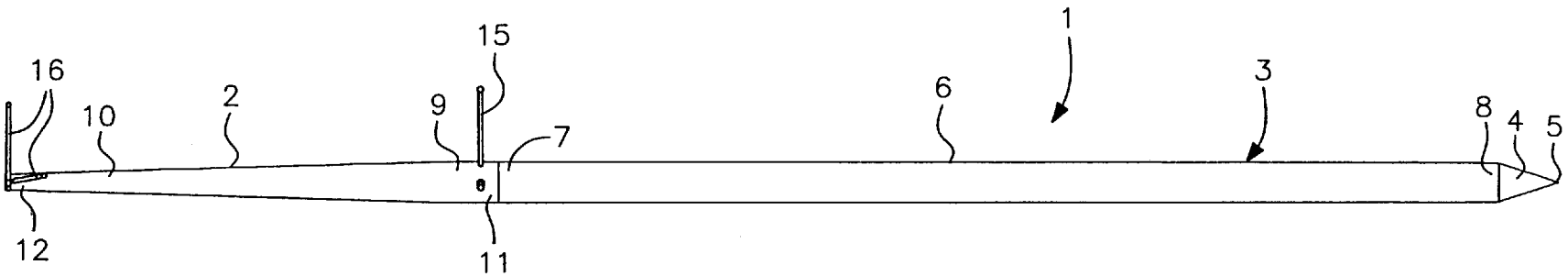
FIG. 3 is a right side view of the antenna carrier of FIG. 1.
Figure 4:
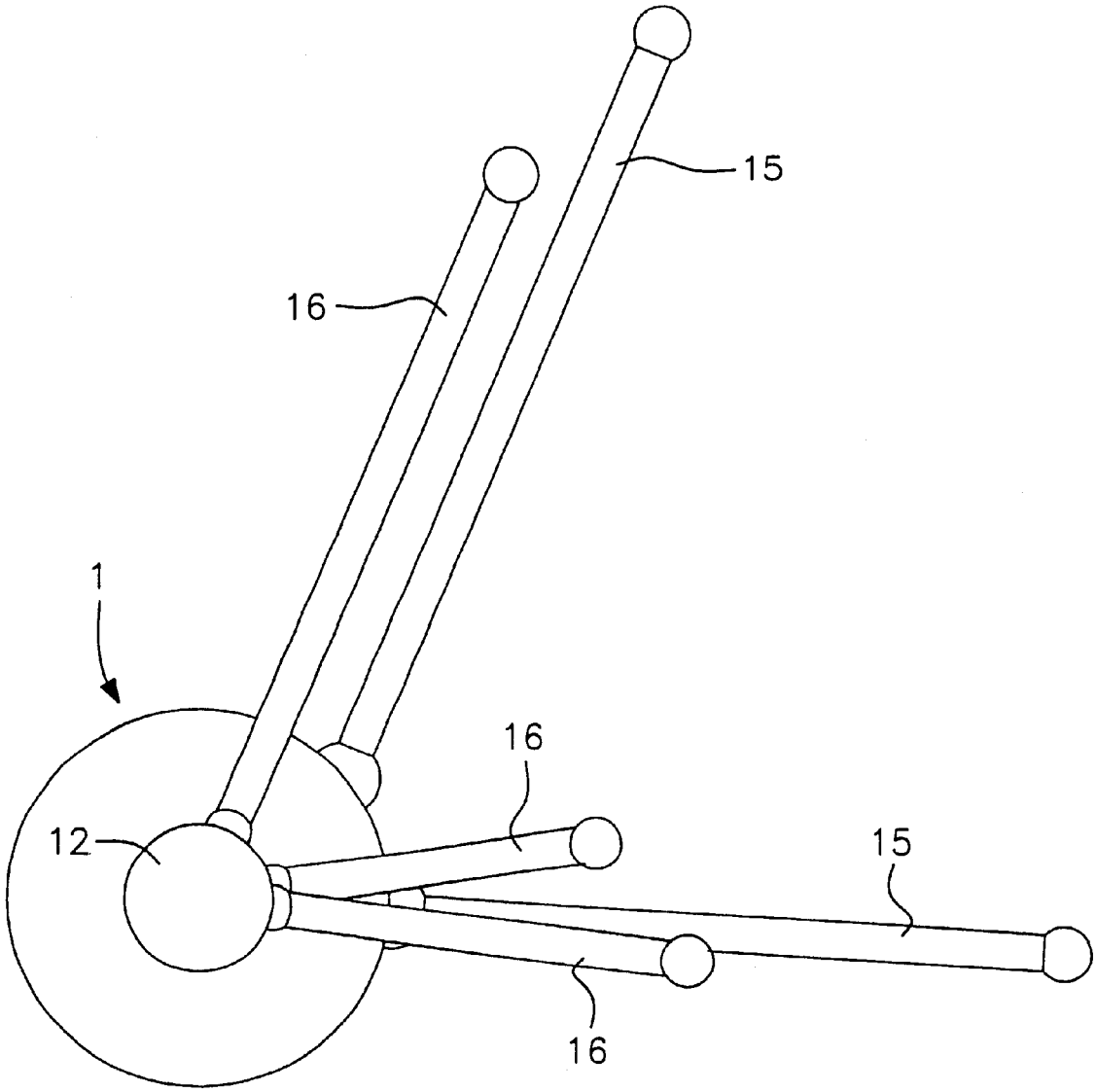
FIG. 4 is a rear end view of the antenna carrier of FIG. 1.

The antenna carrier according to the embodiment illustrated in the FIGS. 1–4 comprises a body 1 which has a mounting part 2, a front part 3 and a nose cone 4. These parts are joined by means of connecting rings. By the body 1 of the antenna carrier being thus composed of separate parts, it is possible to easily manufacture the different portions of the body of different materials containing fibres in different directions and having different wall thickness.

The purpose of the nose cone 4 is to give the body 1 of the antenna carrier an aerodynamic form and to constitute a mounting for de-icing equipment. In the current embodiment, the nose cone 4 has a length of 0.3 m and the shape of a straight cone with a spherically designed point 5. The nose cone 4 should be light and impact resistant and can be made of, for example, 2-mm-thick aramide-fibre reinforced epoxy.

The front part 3 comprises a shell 6 which should have high flexural rigidity and low weight. In the current embodiment, the shell 6 has a length of 5 m and is circular in cross-section. The shell 6 has a slightly conical shape with a diameter which is somewhat greater at the rear end 7 than at the front end 8. At the front the inner diameter is 195 mm and at the back 205 mm. The shell 6 which should be electrically insulating is suitably made up of several layers of wound aramide fibres with epoxy as matrix material. The shell 6 is made by winding on a tool which is slightly conical. In the load-carrying layer, which in the embodiment is 1.6 mm thick, the fibres are applied at such an obtuse angle as possible in relation to the longitudinal direction of the shell for maximum strength and flexural rigidity. An angle of +/−7 degrees in relation to the longitudinal direction has been found appropriate. The inner and the outer part of the shell 6 have an 0.2-mm-thick layer of fibres wound in the transverse direction (90 degrees) to give the shell increased transverse rigidity and reduce the requisite amount of matrix material. The proportion of fibres in the shell conveniently is about 60%. The front part 3 connects at its front end 8 to the nose cone and at its rear end 7 in the mounting part 2. In the embodiment illustrated, the nose cone 4 and the shell 6 of the front part 3 constitute two separate parts but they could also be integrated with each other.

The mounting part 2 is 2.45 m long and has a circular-cylindrical front portion 9 which passes into a straight cone 10. The inner diameter is 205 mm at the front end 11 of the mounting part and 80 mm at the rear end 12 thereof. The mounting part 2 takes up the load exerted by the front part 3 and should have great torsional rigidity while, from a dynamic point of view, it should be pliable. This part is allowed to be electrically conductive and can suitably be made of wound carbon fibres. With a view to obtaining a pliable construction, the fibres are applied at an angle of +/−45 degrees in relation to the longitudinal direction of the mounting part in the embodiment, the fibres are wound to a thickness of 2.5 mm at the front end 11 of the mounting part, which with the current geometry results in a thickness of about 6 mm at the rear end 12 of the mounting part.

The part described above are joined by thick rings of glass-fibre reinforced epoxy by means of an adhesive.

The antenna carrier further comprises a front and a rear mounting point 13, 14 via which a front and a rear part of the mounting part 2 are connected to the air vehicle. In the embodiment shown, the mounting means 15, 16 in the form of articulated struts are arranged between the front mounting point 13 and the air vehicle as well as between the rear mounting point 14 and the air vehicle. The mounting means 16 at the front mounting point 13 suitably consist of two struts which have ball joints at both ends and are arranged in a vertical plane perpendicular to the longitudinal direction of the antenna carrier. The mounting means 16 at the rear mounting point 14 suitably consist of three struts, of which two struts have ball joints at both ends and one strut has a ball joint in its connection to the air vehicle and is rotatably articulated to a spindle in its connection to the mounting part 2. The mounting means 15, 16 can also be designed in other ways. For example, they may consist of flexible struts which are fixedly connected to the antenna carrier and the air vehicle.

The antenna elements are suitably applied to a body of foamed material, which has such a form as to fill the space inside the shell 6 of the front part 3. The foam body is placed inside the shell 6 before the shell and the mounting part 2 are joined together.

By controlling the flexural rigidity so that the antenna carrier is pliable in the area of the rear mounting point 14, a low fundamental tone of the antenna carrier is obtained. By the front part 3 of the antenna carrier being flexurally rigid, the necessary increase of the harmonics is obtained so that they can be made to occur outside the range of the eigenfrequencies of the air vehicle. The separation of fundamental tones and harmonics will be greater the higher flexural rigidity and the lower weight of the front part 3 of the antenna carrier. Since a relatively large part of the antenna carrier, the flexurally rigid front part 3, makes motions of a rigid body, the motions in the antenna carrier will also be small.

What is claimed is:

1. An antenna carrier comprising antenna elements to be connected to an air vehicle, said antenna carrier projecting from a mounting area forwards or rearwards seen in the travelling direction of the air vehicle, characterised in that the antenna carrier comprises an elongate front part (3), which comprises a flexurally rigid shell (6), an elongate, pliable mounting part (2), which at its front end (11) connects to the front part (3), a front mounting point (13) via which a front part of the mounting part (2) is connected to the air vehicle, and a rear mounting point (14) via which a rear part of the mounting part (2) is connected to the air vehicle;

the flexural rigidity of the shell (6) of the front part and the mounting part (2) being adjusted in such manner that the eigenfrequencies of the antenna carrier are well separated from the critical eigenfrequencies of the air vehicle.

2. An antenna carrier as claimed in claim 1, characterised in that the mounting part (2) is narrower at its rear end (12) than at its front end (11).

3. An antenna carrier as claimed in claim 1, characterised in that the mounting part (2) is made of a fibre material, such as carbon fibres, the fibres being directed essentially diagonally in relation to the longitudinal direction of the mounting part.

4. An antenna carrier as claimed in claim 1, characterised in that the shell (6) of the front part (3) comprises a fibre material, for example aramide fibres, the load-carrying fibres being directed essentially in the longitudinal direction of the front part.

5. An antenna carrier as claimed in claim 1, characterised in that articulated mounting means (15, 16) constitute the connection between the front mounting point (13) and the air vehicle as well as between the rear mounting point (14) and the air vehicle.

* * * * *